United States Patent [19]

Williams

[11] 4,123,962

[45] Nov. 7, 1978

[54] ROTARY BREECH APPARATUS FOR AN AUTOMATIC WEAPON

[76] Inventor: Charles E. Williams, 1036 Edwards Ave., Santa Rosa, Calif. 95401

[21] Appl. No.: 770,629

[22] Filed: Feb. 22, 1977

[51] Int. Cl.[2] ..... F41F 11/00

[52] U.S. Cl. ..... 89/13 R; 89/33 MC

[58] Field of Search ..... 89/1.704, 1.801, 1.803, 89/1.805, 9, 13 R, 17, 33 MC, 155; 42/2, 39.5, 60

[56] References Cited

U.S. PATENT DOCUMENTS 2,973,691 3/1961 Goldsmith ..... 89/1.801

*Primary Examiner*—Stephen C. Bentley

*Attorney, Agent, or Firm*—Fulwider, Patton, Rieber, Lee & Utecht

[57] ABSTRACT

A rotary breech apparatus for an automatic weapon of the open chamber type in which the open chamber of the breech rotates past a feeding station to receive a round for firing, then rotates to an ejecting station where the spent round is ejected. A chamber closure mounted next to the breech rotates in the opposite direction about a closure axis which is parallel to the breech axis. The chamber closure includes a surface portion which repetitively closes and seals the open chamber of the breech during the continuous rotation of the breech and the chamber closure. The breech axis is aligned or coaxial with the bore axis of the barrel, and consequently rotation of the breech does not have to be stopped when the round is fired to be assured of perfect alignment.

4 Claims, 8 Drawing Figures

FIG. 1
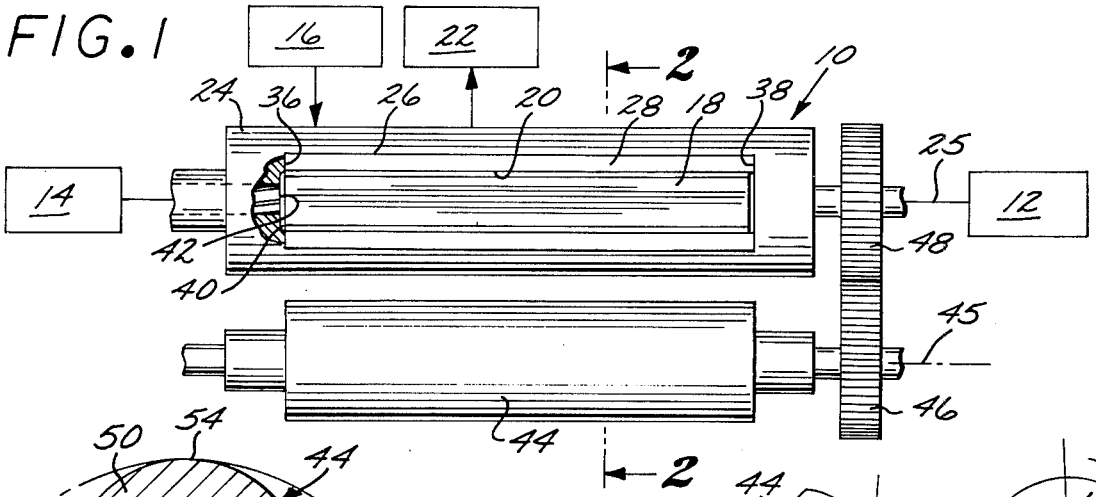
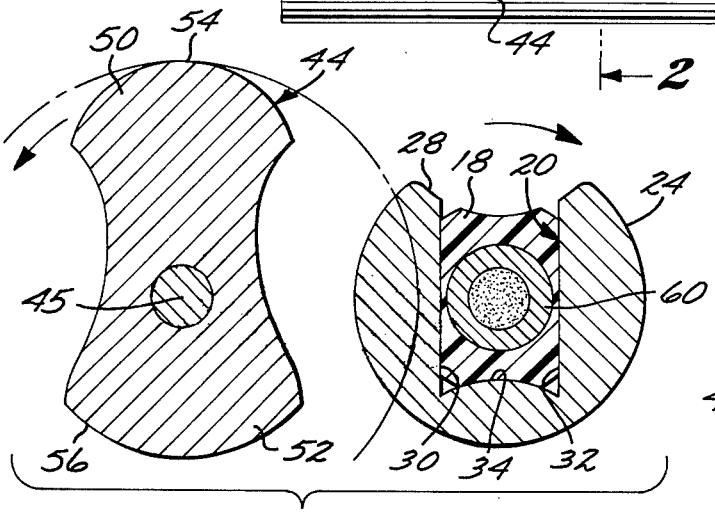
FIG. 2
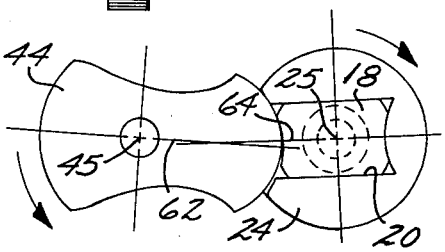
FIG. 3
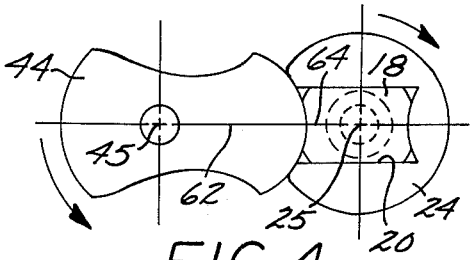
FIG. 4
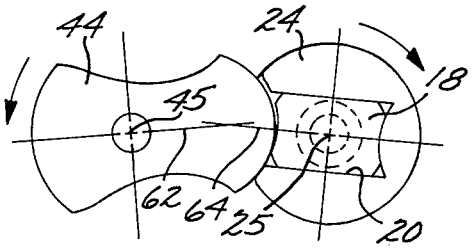
FIG. 5
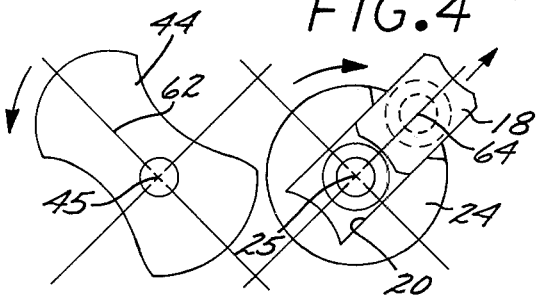
FIG. 6
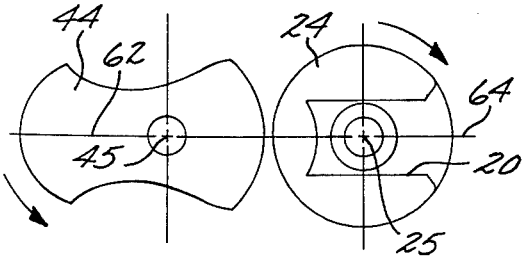
FIG. 7
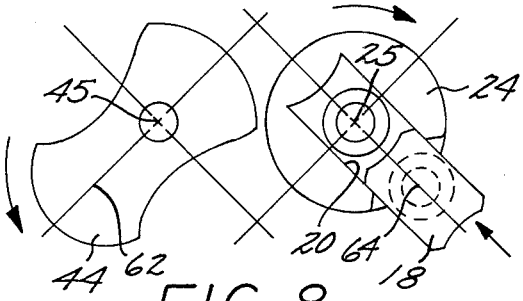
FIG. 8

ROTARY BREECH APPARATUS FOR AN AUTOMATIC WEAPON

BACKGROUND OF THE INVENTION

1. Field of the Invention

The present invention relates to rotary breech apparatus for an automatic weapon of the open chamber type.

2. Description of the Prior Art

Open chamber breech mechanisms are designed to provide high rates of fire and typically employ multiple barrels arranged in a revolving cluster. Single or multiple feed and ejecting stations move cartridges into and out of a breech which is rotated by the propellant gases, or by means such as an electric motor or the like. Each barrel and an aligned firing chamber undergo unified rotation during firing about an axis parallel to and spaced from the barrel. The whirling mass of barrels is characterized by high inertial forces, complexity and significant manufacturing expense. In certain prior art systems only one barrel is used, but the firing chambers still rotate about an axis parallel to and spaced from the barrel. Each firing chamber is halted momentarily as it comes into alignment with the bore, and the consequent intermittent operation greatly reduces the rate of fire in such a system.

Sealing of the open side of the chamber is accomplished in many prior art systems by surrouding the rotatable breech with a sleeve open only at each feed station and at each ejecting station. Sealing of the chamber to prevent the unwanted escape of propellant gases is achieved by frictional engagement between the complemental faces of the sleeve and the cartridges in the breech chambers. This is conducive to cartridge jamming and slows the operation of the weapon.

SUMMARY OF THE INVENTION

According to the present invention, a rotary breech apparatus is provided for use in conjunction with an automatic weapon of the open chamber type. Such a weapon typically includes a means for rotating the breech; a barrel which defines a bore; a round feeding mechanism which automatically feeds a round of ammunition laterally into a chamber of the breech when the chamber comes into opposition with a feeding station; and an ejecting mechanism which automatically ejects the round of ammunition from the chamber after it has been fired and the chamber comes into opposition with an ejecting station. Of course, caseless rounds would not require an ejection station. The breech is open at one end to the bore of the barrel and is apertured at its opposite end for firing of the cartridge primer. The breech is suitably coupled to the breech rotating mechanism for continuous rotation of the breech about an axis which is aligned or coaxial with the bore axis. Thus, the bore and the breech chamber are always aligned despite the continuous or non-intermittent rotation of the breech. Only one barrel need be used, which greatly simplifies the mechanism and reduces complexity, expense, and maintenance.

The breech includes an elongated chamber which opens laterally through the preferably cylindrical surfaces of the breech, and the marginal portions adjacent the breech opening constitute a seal area. A breech closure located adjacent the breech is rotatable about an axis adjacent and parallel to the breech axis. The closure includes a surface portion adapted to repetitively fit against the breech seal area, in complemental relation, during continuous rotation of the breech and closure in opposite directions. Firing of the cartridge occurs during the time the breech seal area is contacted by the closure surface portion.

Usual and conventional mechanisms are employed to feed each cartridge into the breech chamber and eject it at the appropriate time.

The breech chamber cross-section is preferably a modified rectangle, the side of the chamber opposite the open side being inwardly curved or concave, and the configuration of the breech closure surface area being complementally shaped to define an opposed concave wall during firing of the cartridge.

Other objects and features of the invention will become apparent from consideration of the following description taken in connection with the accompanying drawings.

BRIEF DESCRIPTION OF THE DRAWINGS

FIG. 1 is a plan view of the present rotary breech apparatus, illustrated in diagrammatic association with portions of an automatic weapon;

FIG. 2 is a view taken along the line 2—2 of FIG. 1;

FIG. 3 is a diagrammatic showing of the relative positions of the breech and the chamber closure on initial firing of the cartridge;

FIG. 4 is a view similar to FIG. 3 but illustrating the relative positions of the breech and the chamber closure during maximum pressure build-up in the breech chamber; and FIG. 5 is a view similar to FIG. 3 but illustrating the relative positions of the breech and the chamber closure immediately after most of the propellant gases have escaped from the bore and the chamber is just opening;

FIG. 6 is a view similar to FIG. 3 but illustrating the breech member located at the ejecting station;

FIG. 7 is a view similar to FIG. 3 but illustrating the relative positions of the breech and the chamber closure 180° of rotation beyond the positions illustrated in FIG. 3; and FIG. 8 is a view similar to FIG. 3 but illustrating the breech located at the feeding station.

DESCRIPTION OF THE PREFERRED EMBODIMENT

Referring now to the drawings, there is illustrated an improved rotary breech apparatus 10 adapted for use in an open chamber automatic weapon which includes breech rotating means 12; a barrel 14 defining a bore; a round feeding mechanism 16 for automatic feeding of a round of ammunition or cartridge 18 into a breech chamber 20 upon location of the chamber adjacent a feeding station; and a round ejecting mechanism 22 for automatic ejection of the spent cartridge 18 from the chamber 20 upon location of the chamber 20 adjacent an ejecting station.

The construction and operation of the breech rotating means 12, the barrel 14, the round feeding mechanism 16, and the round ejecting mechanism 22 are not a part of the invention and are omitted for brevity. One form of breech rotating means is disclosed in U.S. Pat. Nos. 2,983,223; 3,041,939; and 3,467,276, while an ejecting system is disclosed in U.S. Pat. No. 3,501,998. Such well-known mechanisms are illustrated diagrammatically in the drawings.

Apparatus 10 includes an elongated breech 24 having a longitudinal axis or breech axis 25 coaxial with the barrel 14. As diagrammatically indicated in FIG. 1, the breech 24 is coupled to the breech rotating mechanism 12 for rotation of the breech 24 about the axis 25.

Breech 24 includes a single elongated breech chamber 20 in communication with the bore of the barrel 14. A laterally extending opening 26 communicating with the chamber 20 forms the desired open chamber, and its marginal portions define a first seal area 28 whose purpose will become apparent.

The transverse cross-section of the chamber 20 is generally rectangular and is formed by parallel walls 30 and 32 equidistant from the breech axis 25. The shorter wall 34 of the chamber 20 is inwardly arcuate or convex. The open side of the chamber 20, as will be seen, is intermittently closed by a device having a surface providing a convex wall like the wall 34.

The cartridge 18 is also generally rectangular, and is modified in cross-section to fit within the modified cross-section of the chamber 20. Thus, it is characterized by parallel upper and lower surfaces adapted to closely fit against the chamber walls 30 and 32. The shorter, opposite sides of the cartridge 18 are concave to complementally fit against the chamber wall 34 and the adjacent surface which closes the chamber 20 during firing of the cartridge 18, as will be seen. The opposite end walls of the cartridge 18 are disposed normal to the breech axis and closely fit against the opposite, normally disposed end walls 36 and 38 of the breech chamber 20.

The cartridge may be made of any suitable material for containing the primer, the propellant, and the casing surrounding the projectile. Of course, the casing would be omitted in a caseless round system. Preferably the cartridge is made of a plastic material such as the plastic disclosed in U.S. Pat. No. 3,041,939.

The corners of the cartridge 18 are preferably bevelled to facilitate movement of the cartridge into and out of the chamber 20. In addition, the bore end of the cartridge 18 includes an outwardly projecting bevelled section or boss 40 which closely fits against the margins defining the bore opening in the end wall 36 of the chamber 20. If desired, the bore opening in the end wall 36 can be provided with a bevelled counterbore 42 to closely receive the boss 40, in which case the opposite chamber end wall 38 would be provided with a sloping ramp. This would assist in guiding the boss 40 into position within the counterbore 42. However, if the slight gas leakage can be tolerated, the feeding and ejection of the cartridge would be simplified by eliminating the counterbore and sliding the boss 40 across the end wall 36 to achieve a sealing relation.

It is important to note that during all positions of rotation of the breech 24, the axis of the projectile within the cartridge 18 is aligned with the breech axis 25 and the bore axis. Consequently, despite continuous rotation of the breech 24, only a single barrel is required for any projectile coming out of the rotating breech chamber 20.

The breech apparatus 10 also includes an elongated chamber closure 44 mounted for rotation about a closure axis adjacent to and parallel to the breech axis 25. The closure 44 includes reduced diameter end portions for mounting the closure 44 to the adjacent frame of the weapon (not shown). One end mounts a spur gear 46 which meshes with a similar gear 48 mounted to the adjacent extremity of the breech 24. With this arrangement rotation of the breech 24 in one direction by the breech rotating means 12 results in rotation of the closure 44 in the opposite direction, and at the same rate.

Mounting of the closure 44 and the breech 24 to the parent structure of the associated automatic weapon may be accomplished in any suitable manner, as will be apparent to those skilled in the art, and details thereof are omitted for brevity.

The closure 44 includes a lobe 50 and, preferably, a diametrically oppositely located counter-weight portion 52. Lobe 50 and portion 52 lie on opposite sides of the closure axis 45.

The external configuration of the lobe 50 and the portion 52 is critical only in those complemental areas which come into opposition or registry at the time of firing of the cartridge 18, that is, in the approximate positions illustrated in FIGS. 3, 4 and 5. Thus, the exterior surface 54 constitutes an arc of a circle whose circumference, if continued, would intersect the closure axis 45.

The surface 54 constitutes a sealing area which provides a rolling, sliding fit or seal with the marginal portions defining the chamber opening 26. For this purpose the interiorly disposed margins of the opening 26 are arcuately configured to closely fit the curved surface 54, as shown in FIG. 4, while the more outwardly located portions of the margins defining the opening 26 are reversely curved to provide a rolling, sliding fit with the surface 54 as the breech 24 and closure 44 rotate out of the positions illustrated in FIG. 4.

The counterweight portion 52 is preferably made of a mass sufficient to balance the mass of the lobe 50 and thereby reduce vibration during rotation of the closure 44. In addition, its outer surface 56 is closer to the closure axis 45 than the surface 54 so that it will easily clear all portions of the breech 24, as best seen in FIG. 7. The surfaces of the closure 44 between the lobe 50 and the counterweight portion 52 are arcuately configured to reduce the bulk of the portion 52 and provide a smooth transition between the two sections.

The opposite end walls of the closure 44 are disposed normal to the closure axis 45 and are dimensioned to closely fit against the chamber walls 36 and 38 in the positions of the breech 24 and closure 44 illustrated in FIG. 4. The particular character of the fit between the closure end walls and the chamber walls 36 and 38 is not critical, it being important only that the fit be sufficiently close and of a character that gas leakage is minimized.

The transverse configuration of the cartridge 18 is important to enable its proper fit within the chamber 20, and the central location of the projectile within the cartridge 18 is also important. However, the materials and particular nature of the primer, propellant, and cartridge may be varied according to the particular weapon design. In one embodiment the cartridge is made of suitable plastic material, as previously mentioned, which supports and locates a central, longitudinally extending case 60 within which the projectile, propellant and primer are located.

In FIG. 4 the counter-rotating breech 24 and closure 44 are illustrated at the stage of their cycle of operation in which the lobe 50 completely seals the open side of the chamber 20. At this time a longer transverse axis 62 of the closure 44 is aligned with a longer transverse axis 64 of the chamber 20. By analogy to the Otto cycle of an internal combusion engine, the breech 24 can be said to be located at top dead center.

Using the Otto cycle analogy, and with reference to FIGS. 3 through 8, in FIG. 3 the axis 64 has another approximately 5° of travel to become horizontally oriented. Thus, the breech 24 can be said to be located 5° before top dead center. At this point the cartridge is fired. During the ignition lag before the propellant gases gases develop appreciable pressure, the breech 24 rotates to the top dead center position illustrated in FIG. 4. The propellant gases build up to a maximum pressure at this stage and drive the projectile out of the barrel 14. As the pressure diminishes the breech 24 rotates to the position illustrated in FIG. 5. This is a location of the breech 24 5° beyond top dead center.

Later in the cycle, as at approximately 120° past top dead center, the spent cartridge 18 is ejected from the breech 24, as illustrated in FIG. 6. The breech 24 and closure 44 rotate through the positions of FIG. 7 to those of FIG. 8. At this stage the breech 24 has rotated approximately 240° past top dead center, at which time a fresh cartridge 18 is fed into the chamber 20, and rotation continues to repeat the cycle.

Since the cartridge 18 is always precisely aligned with the barrel 14 it will be apparent that only a single barrel need be utilized despite the continuous rotation of the breech 24.

The precise angular relation of the breech 24 and the closure 44 during the various stages of the operating cycle may be varied according to the character of the weapon, propellant, primer, cartridge, and other variables, as will be apparent. It is important only that the open side of the chamber 20 be closed by the closure 44 during the period when the propellant gases are burning.

Various modifications and changes may be made with regard to the foregoing detailed description without departing from the spirit of the invention.

I claim:

1. In an automatic weapon of the open chamber type which includes a barrel having a bore; a breech located adjacent said barrel and adapted for rotation about a breech axis coaxial with the longitudinal axis of said bore, said breech including an elongated chamber having an opening at one side, the marginal portions adjacent to and defining said opening constituting a first seal area, said first seal area following a circumferential first path of travel during said rotation of said breech; a round feeding mechanism providing automatic feeding of a round of ammunition into said chamber when said opening comes into opposition with a feeding station; a round ejecting mechanism providing automatic ejection of a round of ammunition from said chamber when said opening comes into opposition with an ejecting station; breech rotating means coupled to said breech for rotating said breech about said breech axis thereby successively bringing said opening into opposition with said feeding station and said ejecting station, an improved rotary breech apparatus comprising:

a chamber closure mounted for rotation about a closure axis adjacent and parallel to said breech axis, said closure axis being located outwardly of said first path of travel of said first seal area, said chamber closure having a surface portion constituting a second seal area, said second seal area following a circumferential second path of travel during said rotation of said chamber closure, said second seal area being adapted, upon location of said second seal area in opposition to said first seal area, to seat against said first seal area in complemental relation and thereby substantially prevent escape of propellant gases from said chamber; and coupling means operative to effect rotation of said chamber closure in a direction opposite that of said brecch whereby said first seal area and said second seal area repetitively come into opposition for sealing off said opening to said chamber in timed relation to repetitive firing of rounds in said chamber.

2. A rotary breech apparatus according to claim 1 wherein the wall of said chamber opposite said opening is inwardly directed and generally convex, and said surface portion of said chamber closure is generally convex and thereby defines an inwardly directed, generally convex surface closing said opening upon movement of said first seal area and said second seal area into opposition.

3. A rotary breech apparatus according to claim 1, and in which said breech is generally cylindrical except for said first seal area, said first seal area being recessed radially inwardly; and in which said second seal area is generally arcuate to extend into said breech upon movement of said first seal area and said second seal area into opposition, the portion of said chamber closure opposite said second seal area being sized to prevent obstructing impingement against said breech during rotation of said breech and said chamber closure.

4. A rotary breech apparatus according to claim 3 wherein said second seal area and said marginal portions adjacent to and defining said opening to said chamber are complementally configured to provide a close sliding fit immediately prior to, during, and immediately after said breech and said chamber closure are in opposition.

* * * * *